United States Patent [19]

Patterson et al.

[11] 4,207,978

[45] Jun. 17, 1980

[54] DISPLAY PACKAGE FOR TAPERED CANDLES

[75] Inventors: Michael P. Patterson, Oshkosh, Wis.; William H. Perkins, Oxford, Ohio

[73] Assignee: Paragon Candles, Inc., Oshkosh, Wis.

[21] Appl. No.: 17,610

[22] Filed: Mar. 5, 1979

[51] Int. Cl.[2] ..... B65D 85/20; B65D 5/20

[52] U.S. Cl. ..... 206/443; 206/491; 206/806; 206/198; 229/27

[58] Field of Search ..... 206/45.14, 45.31, 45.34, 206/372, 418–420, 443, 491, 526, 806, 193, 198; 229/15, 16 D, 27, 39 B, 42

[56] References Cited

U.S. PATENT DOCUMENTS

| | | | |
|---|---|---|---|
| 2,503,379 | 4/1950 | Davis | 206/443 X |
| 2,763,398 | 9/1956 | Moore | 206/198 |
| 3,233,726 | 2/1966 | Gero | 229/27 X |

FOREIGN PATENT DOCUMENTS

| | | | |
|---|---|---|---|
| 1211056 | 10/1959 | France | 206/193 |
| 896480 | 5/1962 | United Kingdom | 206/193 |

*Primary Examiner*—William T. Dixson, Jr.

*Attorney, Agent, or Firm*—Ira Milton Jones

[57] ABSTRACT

A container is provided to hold and display a group of fragile articles, such as candles. The container comprises an open-topped box having a rectangular bottom and upright front, back and end walls. Each of the end walls has an upwardly projecting extension the width of which is substantially one-half that of the end wall. One of these upward extensions is adjacent to the front wall and the other is adjacent to the rear wall. The inner edges of these extensions are joined to the opposite edges of a partition wall that lies in a plane parallel to and midway between the front and back of the box. The upward extensions and the partition thus cooperate to form a pair of back-to-back vertical compartments above the top of the box, each having a back formed by the partition wall and one side formed by one of the extensions. Articles set vertically into the box have their upper portions received in the vertical compartments to be supported thereby in upright arrangement exposed to view and to inspection. Suitable wrappings that are preferably transparent are placed around exposed portions of the articles and the container to secure them together.

2 Claims, 6 Drawing Figures

DISPLAY PACKAGE FOR TAPERED CANDLES

This invention relates to containers or packages for use in the support, protection, containment, inspection and display of articles for sale. More particulary, it relates to containers providing protection and support for fragile articles and containment for a plurality of loose articles while enabling the ready display and inspection of the articles.

The object of the present invention is to provide an exceptionally attractive way of displaying such articles as candles for retail sale.

More specifically, this invention has as its purpose the provision of a container that can stand on a shelf or hang from a hook and in which a group of candles or similar articles, can be firmly held in an upright position with the major length thereof clearly visible for inspection, yet held neatly upright.

To achieve the foregoing objectives the invention resides in a container adapted to hold and attractively display a group of candles for retail sales purposes, comprising means defining an open-topped box having a bottom wall, opposite front and back walls and opposite end walls; upward extension walls on said opposite end walls, said upward extension walls being integral continuations of their respective end walls and being substantially half the width of said end walls at their junction with the end walls; and a partition joined to and supported by said extension walls, said extension walls being joined to the opposite edges of the partition and projecting in opposite directions from the partition, said partition rising from the open top of the box at a position substantially equispaced between the front and back walls thereof, and said partition being substantially parallel to the front and back walls, whereby said upward extension walls and the partition coact to define a pair of vertical compartments that project above the open top of the box and have a back wall and one side wall, so that candles that are set vertically into said box have the major portions thereof exposed to inspection and yet held neatly upright.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

Figure 1:
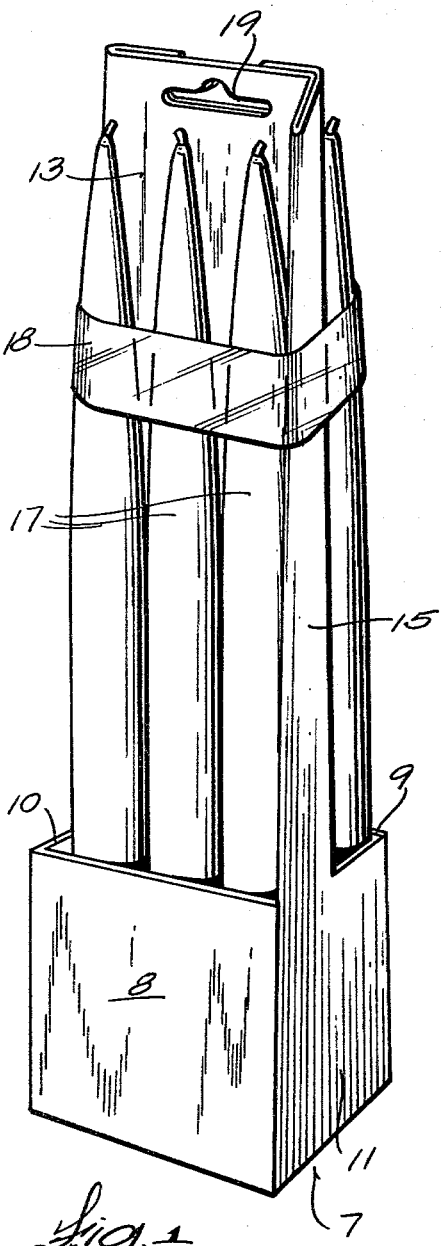
FIG. 1 is a perspective view of a container constructed in accordance with the present invention and illustrating the manner in which candles, or similar objects, may be protectively held thereby for ready display.
Figure 3:
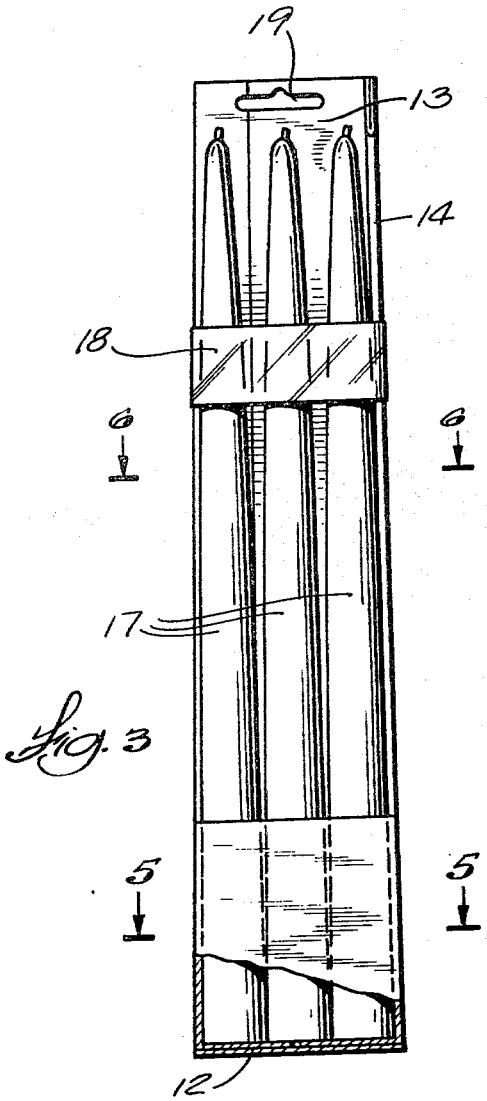
FIG. 3 is a view partially in section, taken from the back of the container shown in FIG. 1.
Figure 4:
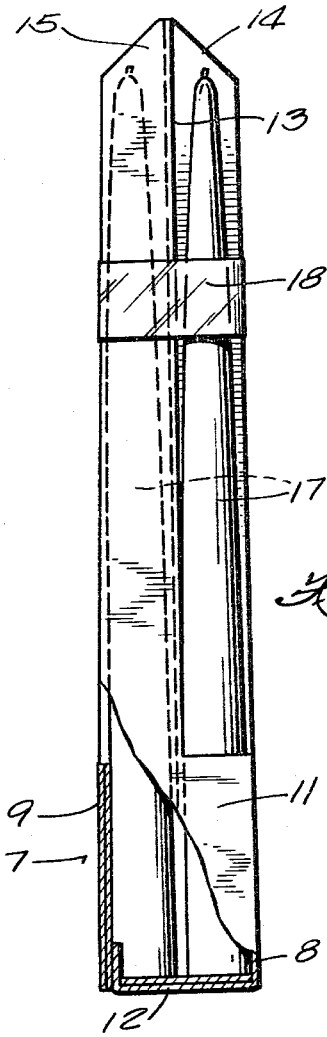
FIG. 4 is a view partially in section, taken from the left side of the container shown in FIG. 1.
Figure 5:
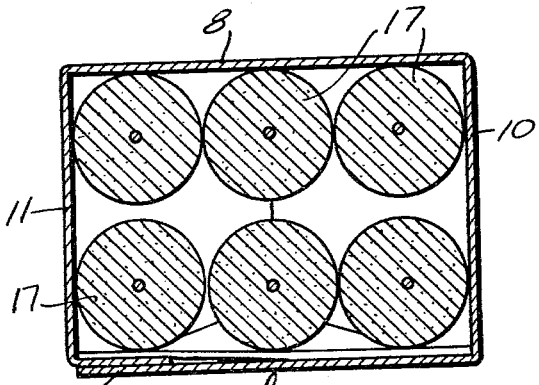
FIG. 5 is a horizontal sectional view on an enlarged scale, through the container and its contents, taken on the plane of the line 5—5 in FIG. 3.

Referring to the drawings, and especially to FIG. 1, it will be seen that the lower portion of the container can be considered an open-topped rectangularly shaped box, indicated generally by the numeral 7, having parallel front and back walls 8 and 9 respectively connected by opposite left and right side walls 10 and 11 respectively, all of these walls rising perpendicularly from a bottom wall 12 not visible in FIG. 1 but shown in FIGS. 3 and 4.

The distinguishing characteristic of the container of this invention resides in the portion thereof above the top of the box 7. That upper portion of the container comprises a vertical wall 13 equispaced from and parallel to the front and back walls 8 and 9; and upward extensions 14 and 15 of the left and right side walls 10 and 11. Although from the standpoint of the intended use of the container, the wall 13 could extend down to the bottom wall 12, to enable formation of the container from the scored and slit paperboard blank 16 shown in FIG. 2, the bottom edge of the wall 13 is horizontally aligned with the top edges of the front, back and side walls of the open-topped box 7.

The upward extensions 14 and 15 are diagonally opposite one another and project in opposite directions from the side edges of the wall 13. At their junctions with their respective side walls 10 and 11, the width of these extensions is just half that of the side walls, but towards the top they are slightly taperingly reduced in width.

By virtue of the aforesaid disposition and dimensions of the upward extensions with respect to the wall 13, the upper portion of the container, i.e. that part thereof above the open-topped box 7, forms back-to-back compartments each having a wide back provided by the wall 13 and one narrow side formed by either the extension 14 or 15. The wall 13 thus can be considered a partition separating those back-to-back compartments; but the important thing about these compartments is that they communicate with the open top of the box 7 and hold groups of elongated articles that are set vertically into the box—as, for instance, the tapered candles 17 shown in the drawings—neatly upright while leaving the major portion thereof exposed to view and inspection.

Displacement of the packaged articles, i.e., the tapered candles, is prevented by a band 18 of transparent tape or the like, wrapped around the upper portion of the package.

Because of its flat bottom the filled container can be set on a shelf, or—if desired—can be hung from a hook or peg, for which purpose the partition wall 13 is apertured near its top, as at 19.

Figure 2:
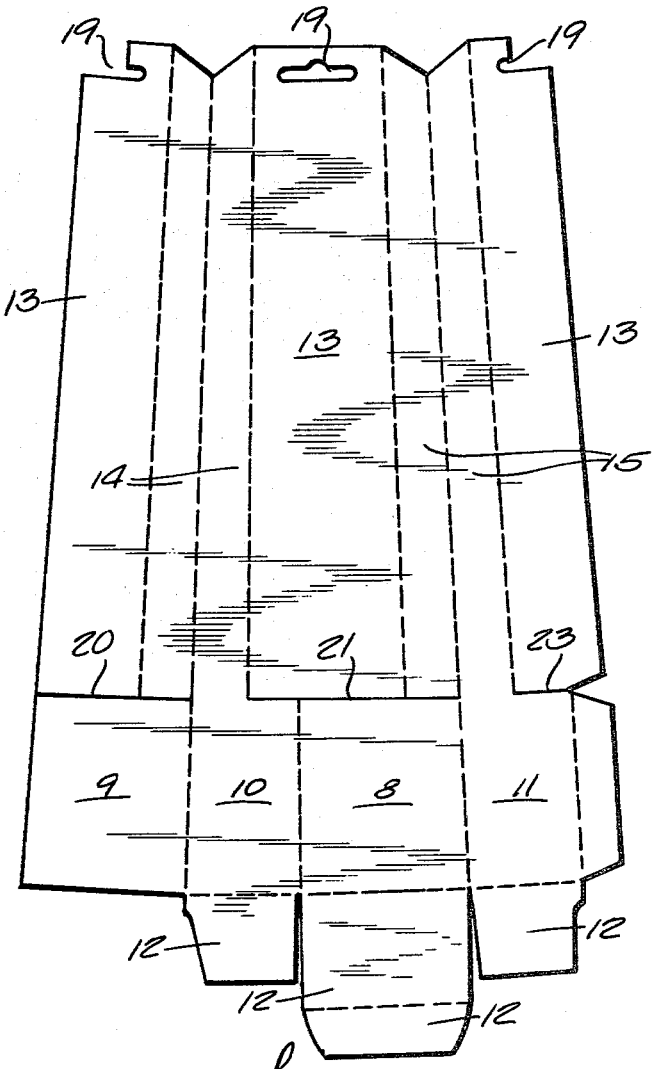
FIG. 2 is a plan view of the scored and slit paperboard blank of which the container shown in FIG. 1 is made.
Figure 6:
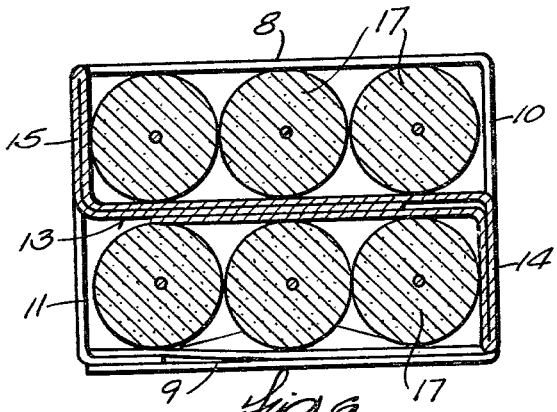
FIG. 6 is a horizontal sectional view similar to FIG. 5, but taken on the plane of the line 6—6 in FIG. 3.

The illustration in FIG. 2 of the blank 16 from which the container is formed is no doubt self-sufficient and requires no definition for someone skilled in the art to understand how that blank is folded to form the container, beyond noting that the blank is scored along the dotted lines (in FIG. 2) to define the locations of the folds, and is slit or cut along the full lines 20, 21 and 23 to permit the lower portion of the blank to be formed into the open-topped box 7 and the upper portion of the blank to be shaped into the back-to-back compartments. The reference numerals in FIG. 2 correlate the portions of the blank with the various parts (walls, etc.) of the container. In this connection, it should be noted that since the partition wall 13 and the upward extensions 14 and 15 are formed by overlying parts of the blank, as best shown in FIG. 6, those reference numerals in FIG.

2 are repeated where necessary to designate all parts of the blank that, in the finished container, overlie one another and in some instances are glued together.

Actually, the narrow extensions 14 and 15 of the finished container may be said to be of double thickness with the plys thereof joined together by extensions of the same scoring that defines one edge of the front wall and the diagonally opposite edge of the backwall.

Those skilled in the art will appreciate that the invention can be embodied in forms other than as herein disclosed for purposes of illustration.

We claim:

1. A container formed from a single elongated blank of paperboard and adapted to hold and attractively display a group of candles or similar articles, comprising:

A. means defining an open topped rectangularly shaped box having upright opposite front and back walls, upright opposite end walls, and a flat bottom wall, said means comprising slits and scoring in the blank at one end thereof providing bottom wall forming flaps connected by said scoring to the lower edge of each end wall and to the lower edge of one of said front and back walls;

B. an upright partition wall rising above the open top of the box in a plane substantially equispaced from the front and back walls thereof;

C. a substantially narrow extension wall rising from each end wall as an upward continuation thereof, one of said extension walls projecting forwardly from scoring defining one edge of the partition wall and the other extension wall projecting rearwardly from scoring defining the opposite edge of the partition wall, whereby said extension walls provide support for the partition wall, (1) said extension walls being of double thickness and the plys thereof being joined together by scoring which extends longitudinally of the blank and comprises continuations of the same scoring that defines the junction of the front wall with one end wall and the junction of the back wall with the opposite end wall, (2) one ply of each of said narrow walls being integral with its respective end wall and the other plys thereof being separated from the walls of the box by slits which extend transversely of the blank and define upper edges of the box, whereby said extension walls and the partition wall coact to define a pair of back to back vertical compartments that communicate with the open top of the box and have only a back wall and one side wall, so that candles set vertically into said box have the portions thereof that project above its open top received in said vertical compartments and thereby held neatly upright while being exposed to inspection.

2. The container of claim 1, wherein said partition wall has multiple thickness and comprises (1) a first wall portion which is disposed centrally of the blank and extends across the entire width of the container from one of said extension walls to the other thereof, and (2) overlapping wall portions which flatwise overlie said partition wall at the back thereof, and which overlapping wall portions comprise marginal portions of the blank along its opposite longitudinal edges, which are separated from the walls of the box by said slits defining the upper edges of the box, and which marginal portions are joined to said upward extensions by scoring that extends longitudinally of the blank.

* * * * *